US012774600B2

(12) United States Patent
Brasier et al.

(10) Patent No.: US 12,774,600 B2
(45) Date of Patent: Oct. 27, 2026

(54) ACOUSTIC ATTENUATION DEVICE PROVIDED WITH INSERTS MADE OF ACOUSTICALLY ABSORBENT MATERIAL

(71) Applicants: VICAT, L'Isle-d'Abeau (FR); ECOLE NATIONALE DES TRAVAUX PUBLICS DE L'ETAT ENTPE, Vaulx-en-Velin (FR)

(72) Inventors: Nicolas Brasier, Pont de Beauvoisin (FR); Benoit Montazeaud, Vienne (FR); Emmanuel Gourdon, Lyons (FR); Fulbert Mbailassem, Vaulx en Velin (FR)

(73) Assignees: VICAT, L'Isle-d'Abeau (FR); ECOLE NATIONALE DES TRAVAUX PUBLICS DE L'ETAT ENTPE, Vaulx-en-Velin (FR)

( * ) Notice: Subject to any disclaimer, the term of this patent is extended or adjusted under 35 U.S.C. 154(b) by 287 days.

(21) Appl. No.: 18/287,402
(22) PCT Filed: Apr. 13, 2022
(86) PCT No.: PCT/FR2022/050696
§ 371 (c)(1),
(2) Date: Oct. 18, 2023
(87) PCT Pub. No.: WO2022/223906
PCT Pub. Date: Oct. 27, 2022
(65) Prior Publication Data
US 2024/0200327 A1 Jun. 20, 2024
(30) Foreign Application Priority Data
Apr. 19, 2021 (FR) ..... 21/04038
(51) Int. Cl.
*E04B 1/68* (2006.01)
*E04B 1/99* (2006.01)
(52) U.S. Cl.
CPC ..... *E04B 1/99* (2013.01); *E04B 1/6804* (2013.01)
(58) Field of Classification Search
CPC ..... E04B 1/84; E04B 1/8404; E04B 1/8409; E04B 1/82; E04B 1/8209; E04B 1/86;
(Continued)

(56) References Cited

U.S. PATENT DOCUMENTS 2,071,865 A * 2/1937 Parsons ..... E04B 9/247 52/145
2,271,871 A 2/1942 Newport et al.
(Continued)

FOREIGN PATENT DOCUMENTS

DE 1509156 A1 12/1968
GB 997435 A 7/1965

OTHER PUBLICATIONS

International Search Report dated Jul. 26, 2022; International Application No. PCT/FR2022/050696; 2 pages (English).
(Continued)

*Primary Examiner* — Jessica L Laux
(74) *Attorney, Agent, or Firm* — CANTOR COLBURN LLP

(57) ABSTRACT

An acoustic attenuation device having two inserts made of acoustically absorbent material, the two inserts being different from each other and being separated from each other so as to delimit between them a longitudinal slot, each insert including a front surface intended to be oriented towards a space to be acoustically attenuated; and two support elements which are made of substantially acoustically impermeable material and which at least partially delimit an internal cavity in which the two inserts are disposed, each support element including a cover part partially covering the front surface of a respective insert such that the front surfaces of the two inserts are partially exposed, the two cover parts delimiting at least one passage opening which emerges into the internal cavity and which is located at least partially opposite the longitudinal slot so as to clear an access to the longitudinal slot.

20 Claims, 4 Drawing Sheets

(58) Field of Classification Search
CPC . E04B 1/88; E04B 1/6804; E04B 1/90; E04B 9/001; E04B 9/0464; E04B 9/0485; E04B 9/0428; E04B 2001/8263
See application file for complete search history.

(56) References Cited

U.S. PATENT DOCUMENTS 3,903,660 A * 9/1975 Akins ..... F24F 13/078 52/27
4,702,046 A * 10/1987 Haugen ..... E04B 1/86 52/144
5,709,053 A * 1/1998 Kuroda ..... E04B 1/86 52/794.1
5,756,942 A * 5/1998 Tanaka ..... E04B 9/001 181/290
6,640,507 B1 * 11/2003 Leconte ..... E04B 1/86 52/145

OTHER PUBLICATIONS

International Search Report dated Jul. 26, 2022; International Application No. PCT/FR2022/050696; 3 pages (non-English).
Written Opinion dated Jul. 26, 2022; International Application No. PCT/FR2022/050696; 7 pages (non-English).

* cited by examiner

ACOUSTIC ATTENUATION DEVICE PROVIDED WITH INSERTS MADE OF ACOUSTICALLY ABSORBENT MATERIAL

CROSS REFERENCE TO RELATED APPLICATIONS

This application is a National Stage of PCT Application No. PCT/FR2022/050696 filed on Apr. 13, 2022, which claims priority to French Application No. 21/04038 filed on Apr. 19, 2021, the contents each of which are incorporated herein by reference thereto.

TECHNICAL FIELD

The present disclosure concerns an acoustic attenuation device, for example for buildings.

BACKGROUND

In order to attenuate the noise in a building, it is known to place acoustic attenuation panels on the interior walls and/or the ceilings of the building.

Such acoustic attenuation panels may for example be made of polystyrene, cement concrete or even glass wool or rock wool. However, such acoustic attenuation panels have drawbacks.

Indeed, the polystyrene acoustic attenuation panels have relatively low fire resistance and recyclability and have a significant environmental impact, and the glass wool and rock wool acoustic attenuation panels also have a low recyclability. In addition, the cement concrete acoustic attenuation panels have relatively low or even zero acoustic absorption properties if not combined with porous panels with acoustic absorption properties. However, the use of porous panels may be difficult or inappropriate, especially in humid environments, such as in the swimming pools.

BRIEF SUMMARY

The present disclosure aims to remedy all or part of these drawbacks.

The technical problem underlying the present disclosure therefore consists in providing an acoustic attenuation device which is of simple and economical structure, while having improved acoustic attenuation performance.

To this end, the present disclosure concerns an acoustic attenuation device including:

- two inserts made of acoustically absorbent material, the two inserts being distinct from each other and being separated from each other so as to delimit a longitudinal slot between them, each insert including a front surface intended to be oriented towards a space to be acoustically attenuated, and
- two support elements which are made of substantially acoustically impermeable material and which at least partially delimit an internal cavity in which the two inserts are disposed, each support element including a cover part partially covering the front surface of a respective insert such that the front surfaces of the two inserts are partially exposed, the two cover parts delimiting at least one passage opening which emerges into the internal cavity and which is located at least partially opposite the longitudinal slot so as to clear an access to the longitudinal slot, from the outside of the acoustic attenuation device and in particular from the space to be acoustically attenuated.

The presence of the longitudinal slot between the two inserts made of acoustically absorbent material and of the at least one passage opening introduces surface irregularities at the exposed face of the acoustic attenuation device which is intended to be oriented towards the space to be acoustically attenuated.

Such surface irregularities, coupled with the presence of the two inserts made of acoustically absorbent material, respectively induce phenomena of diffraction of the sound waves coming from the space to be acoustically attenuated and phenomena of acoustic absorption of said sound waves. In addition, the presence of the longitudinal slot induces phenomena of pressure diffusion increasing the acoustic absorption at low frequencies.

Consequently, the acoustic attenuation device according to the present disclosure has improved acoustic attenuation performance compared to the acoustic attenuation devices of the prior art, and in particular a high acoustic absorption coefficient over a wide frequency range, and this while a large part of the external surfaces of the acoustic attenuation device in contact with the air, and therefore with the sound waves, is made of a substantially acoustically impermeable material. In particular, the acoustic attenuation device may attenuate the surrounding noise in a wide frequency range by adapting the dimensions of the longitudinal slot, of the cover parts and of the at least one passage opening.

In addition, such a configuration of the acoustic attenuation device according to the present disclosure makes it possible to produce a maximum of external surfaces of the acoustic attenuation device in substantially acoustically impermeable material, such as concrete or metal, and therefore to give the acoustic attenuation device a high mechanical strength.

The acoustic attenuation device may additionally have one or more of the following characteristics, taken alone or in combination.

According to one embodiment of the present disclosure, the acoustic attenuation device includes an exposed face which is intended to be oriented towards the space to be acoustically attenuated and to be located in the latter, the exposed face being partly defined by the two cover parts.

According to one embodiment of the present disclosure, the acoustic attenuation device has an acoustic absorption coefficient greater than 0.5.

According to one embodiment of the present disclosure, the internal cavity communicates with the exterior of the acoustic attenuation device through the at least one passage opening, and preferably only through the at least one passage opening.

According to one embodiment of the present disclosure, the internal cavity extends longitudinally.

According to one embodiment of the present disclosure, the internal cavity has a generally parallelepipedic shape.

According to one embodiment of the present disclosure, the two cover parts extend substantially in the same plane.

According to one embodiment of the present disclosure, each insert has a rectangular section.

According to one embodiment of the present disclosure, the at least one passage opening is elongated and extends in a direction of extension.

According to one embodiment of the present disclosure, the at least one passage opening is a passage slot which has a width greater than a width of the longitudinal slot. Such a configuration of the passage opening, coupled with the presence of an acoustically absorbent material at the rear of the passage opening, forms a resonator which further improves the acoustic performance of the acoustic attenuation device according to the present disclosure.

According to one embodiment of the present disclosure, the passage slot has a width comprised between 2 and 10 cm, and for example between 7 and 8 cm.

According to one embodiment of the present disclosure, the longitudinal slot has a width comprised between 0.5 and 1.9 cm, and for example of approximately 1 cm.

According to one embodiment of the present disclosure, the longitudinal slot is centered with respect to the passage slot.

According to one embodiment of the present disclosure, the passage slot has the same length as the internal cavity.

According to one embodiment of the present disclosure, the internal cavity has a width greater than the width of the passage slot.

According to one embodiment of the present disclosure, the passage slot is substantially parallel to the longitudinal slot.

According to one embodiment of the present disclosure, each insert is elongated and extends in a direction of extension.

According to one embodiment of the present disclosure, each insert extends substantially parallel to the longitudinal slot.

According to one embodiment of the present disclosure, each insert is made of hemp concrete.

According to another embodiment of the present disclosure, each insert could be made of mineral wool, for example glass wool or rock wool, or an acoustically absorbent foam.

According to one embodiment of the present disclosure, each cover part has a thickness less than the thickness of the respective insert.

According to one embodiment of the present disclosure, each cover part has a thickness comprised between 1 mm and 3 cm, and for example between 1 and 5 mm, and advantageously between 1 and 3 mm.

According to one embodiment of the present disclosure, each insert has a thickness comprised between 3 and 10 cm, and for example between 3.5 and 6 cm.

According to one embodiment of the present disclosure, each support element is metallic, and for example made of stainless steel.

According to one embodiment of the present disclosure, each support element is made of cement concrete, and for example of Ultra High Performance Fiber Concrete (UHPC).

According to one embodiment of the present disclosure, each support element has an angle iron shape. In other words, each support element has an L cross-section.

According to one embodiment of the present disclosure, the two support elements are distinct from each other and separated from each other.

According to one embodiment of the present disclosure, the acoustic attenuation device includes a rear wall connecting the two support elements to each other, the rear wall and the two support elements forming a box and delimiting the internal cavity in which the two inserts are disposed.

According to one embodiment of the present disclosure, the two support elements respectively form the two lateral walls of the box.

According to one embodiment of the present disclosure, the two cover parts extend substantially parallel to the rear wall.

According to one embodiment of the present disclosure, the box is elongated.

According to one embodiment of the present disclosure, the box has a generally parallelepipedal shape.

According to one embodiment of the present disclosure, the acoustic attenuation device further includes a structural layer which is made of a substantially acoustically impermeable material, the two inserts and the two support elements being fastened to, and for example at least partially integrated in, the structural layer. The fact of making the structural layer made of a substantially acoustically impermeable material gives the acoustic attenuation device significant insulation properties against the external noise. The realization of the acoustic attenuation device according to the present disclosure from a structural layer also ensures a high mechanical strength to the acoustic attenuation device.

According to one embodiment of the present disclosure, the substantially acoustically impermeable material forming the structural layer has an acoustic absorption coefficient less than 0.2.

According to one embodiment of the present disclosure, the structural layer is obtained by hardening a cementitious composition.

According to one embodiment of the present disclosure, the cementitious composition forming the structural layer includes at least one hydraulic binder.

According to one embodiment of the present disclosure, the hydraulic binder includes at least one cement chosen from a Portland cement, an aluminous cement, a sulfoaluminate cement and/or a prompt natural cement.

According to one embodiment of the present disclosure, the structural layer is made of cement concrete.

According to one embodiment of the present disclosure, the structural layer includes a first external surface and a second external surface opposite the first external surface, the first external surface being intended to be oriented towards the space to be acoustically attenuated.

According to one embodiment of the present disclosure, the structural layer has a substantially parallelepipedal shape.

According to one embodiment of the present disclosure, each insert includes a first lateral surface and a second lateral surface which is opposite to the respective first lateral surface, the first lateral surfaces of the two inserts delimiting the longitudinal slot. Advantageously, the first lateral surfaces of the two inserts are located directly opposite each other. In other words, no structural element is disposed between the first lateral surfaces of the two inserts.

According to one embodiment of the present disclosure, the cover parts extend on either side of a longitudinal plane extending between the two inserts and in the longitudinal slot, and more particularly extend longitudinally on either side of the longitudinal slot.

According to one embodiment of the present disclosure, each support element, and more particularly the cover part of each support element, extends along the respective insert.

According to one embodiment of the present disclosure, each cover part includes an internal longitudinal edge, the internal longitudinal edges of the two cover parts delimiting the at least one passage opening.

According to one embodiment of the present disclosure, each support element is elongated and extends substantially parallel to the longitudinal slot.

According to one embodiment of the present disclosure, each support element includes a fastening part fastened to the structural layer. Advantageously, each fastening part is partially integrated into the structural layer.

According to one embodiment of the present disclosure, each fastening part is secured to the structural layer during the hardening of the cementitious composition forming the structural layer.

According to one embodiment of the present disclosure, the two inserts are spaced from each other by a distance less than the width of an insert.

According to one embodiment of the present disclosure, the longitudinal slot has a width greater than one tenth of the width of the passage slot.

According to one embodiment of the present disclosure, the passage slot has a width less than twice the width of an insert.

According to one embodiment of the present disclosure, each insert is in one piece, that is to say it is made in one piece.

The present disclosure also concerns an acoustic attenuation assembly comprising a retaining element and at least two acoustic attenuating devices according to the present disclosure, each acoustic attenuating device being fastened to the retaining element.

According to one embodiment of the present disclosure, the acoustic attenuation assembly is configured to be disposed between two concrete pre-slabs. Advantageously, the acoustic attenuation assembly is configured to rest on the concrete pre-slabs.

According to one embodiment of the present disclosure, the two acoustic attenuation devices are spaced from each other and extend substantially in the same plane of extension.

According to one embodiment of the present disclosure, the acoustic attenuation assembly includes a retaining element, for example metallic, including a retaining part which is substantially planar, the support elements of the two acoustic attenuation devices being fastened to the retaining part so that the retaining part and the support elements form two boxes delimiting two internal cavities in each of which the two respective inserts are disposed.

According to one embodiment of the present disclosure, the retaining element further includes two lateral bearing parts which are configured to rest on the pre-slabs.

According to one embodiment of the present disclosure, the retaining part includes, on its face opposite the acoustic attenuation devices, anti-slip projections.

According to one embodiment of the present disclosure, the acoustic attenuation assembly includes a support part which is fastened to the retaining element, the support part including two lateral branches which respectively form the adjacent support elements of the two acoustic attenuation devices.

According to one embodiment of the present disclosure, the support part further includes a central chute which connects the two lateral branches of the support part to each other, the central chute and the retaining part delimiting a central cavity.

According to one embodiment of the present disclosure, the acoustic attenuation assembly further includes perforated cover elements which partially cover the passage openings delimited by the support elements. Advantageously, each perforated cover element is metallic, and has a perforation rate greater than 70%.

According to one embodiment of the present disclosure, each perforated cover element is fastened, preferably in a removable manner, to the cover parts of the support elements of a respective acoustic attenuation device.

According to one embodiment of the present disclosure, the acoustic attenuation assembly includes a closure plate which is removable and which delimits, with the support part, an internal chamber in which longitudinal elements, such as fluid pipes and/or electric cables, may be disposed.

The present disclosure further concerns a construction element for a building comprising a support structure and a plurality of acoustic attenuation devices according to the present disclosure, each acoustic attenuation device being fastened to the support structure.

According to one embodiment of the present disclosure, the acoustic attenuation devices are disposed substantially parallel to each other.

According to one embodiment of the present disclosure, the support structure is made of a substantially acoustically impermeable material.

According to one embodiment of the present disclosure, the substantially acoustically impermeable material forming the support structure has an acoustic absorption coefficient less than 0.2.

According to one embodiment of the present disclosure, the support structure is obtained by hardening a hardenable material.

According to one embodiment of the present disclosure, the hardenable material is a cementitious composition.

According to one embodiment of the present disclosure, the support structure is made of cement concrete.

According to one embodiment of the present disclosure, each acoustic attenuation device is at least partially embedded in the support structure before the hardening of the hardenable material forming the support structure.

According to another embodiment of the present disclosure, each acoustic attenuation device is attached to the support structure. Each acoustic attenuation device may for example be fastened to the support structure by gluing, clipping, screwing or by any other means.

According to one embodiment of the present disclosure, two adjacent acoustic attenuation devices of said plurality of acoustic attenuation devices are connected to each other by a connecting wall which partially delimits a longitudinal internal chamber.

According to one embodiment of the present disclosure, the connecting wall and the cover parts of the two adjacent acoustic attenuation devices extend substantially in the same plane.

According to one embodiment of the present disclosure, the construction element includes fluid pipes and/or electric cables extending in the longitudinal internal chamber.

According to one embodiment of the present disclosure, the support structure includes:

- a plurality of concrete pre-slabs spaced from each other, one or more acoustic attenuation devices being disposed between two adjacent concrete pre-slabs, and
- a concrete layer poured over the concrete pre-slabs and the acoustic attenuation devices so as to secure the concrete pre-slabs and the acoustic attenuation devices.

According to one embodiment of the present disclosure, the construction element includes fluid flow tubes, such as PEX tubes, positioned on the pre-slabs and embedded in the concrete layer.

According to one embodiment of the present disclosure, the construction element is intended to form at least partially a ceiling, a wall or a floor.

According to one embodiment of the present disclosure, the construction element is a pre-slab.

According to one embodiment of the present disclosure, the construction element is a slab.

BRIEF DESCRIPTION OF THE DRAWINGS

In any event, the present disclosure will be better understood with the aid of the following description with reference to the appended diagrammatic drawings representing, by way of non-limiting examples, several embodiments of this acoustic attenuation device.

DETAILED DESCRIPTION

Figure 1:
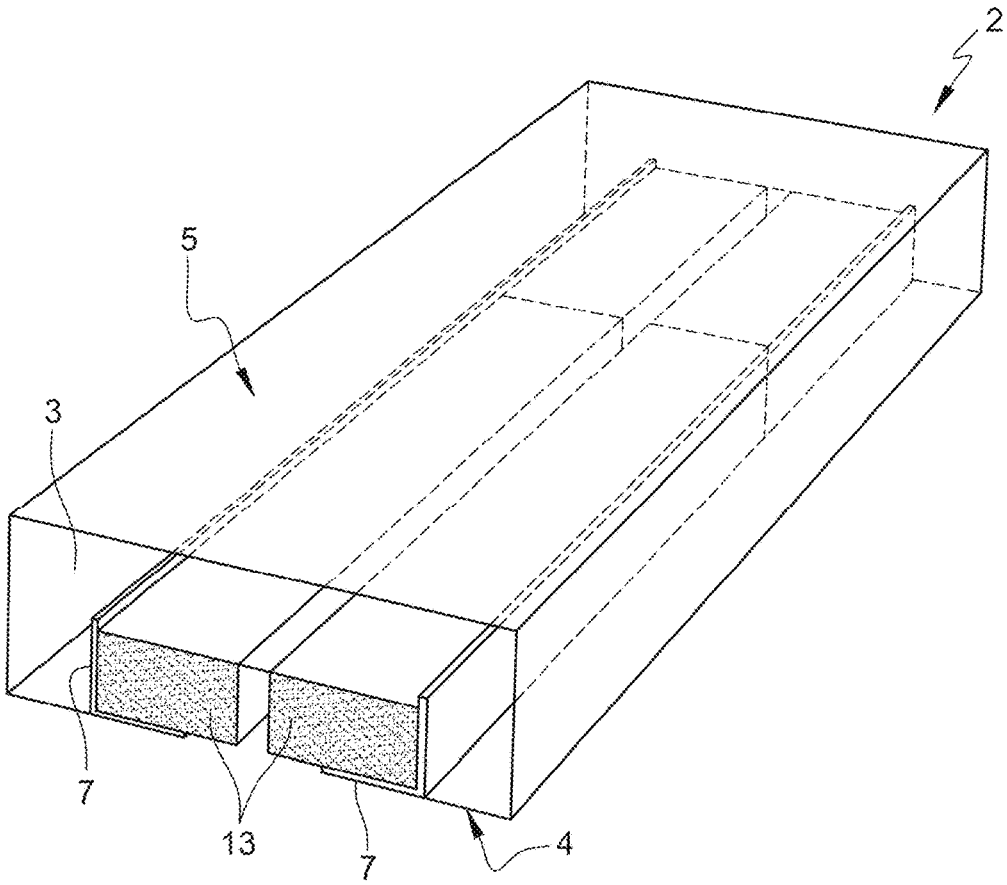
FIG. 1 is a perspective view of an acoustic attenuation device according to a first embodiment of the present disclosure.
Figure 2:
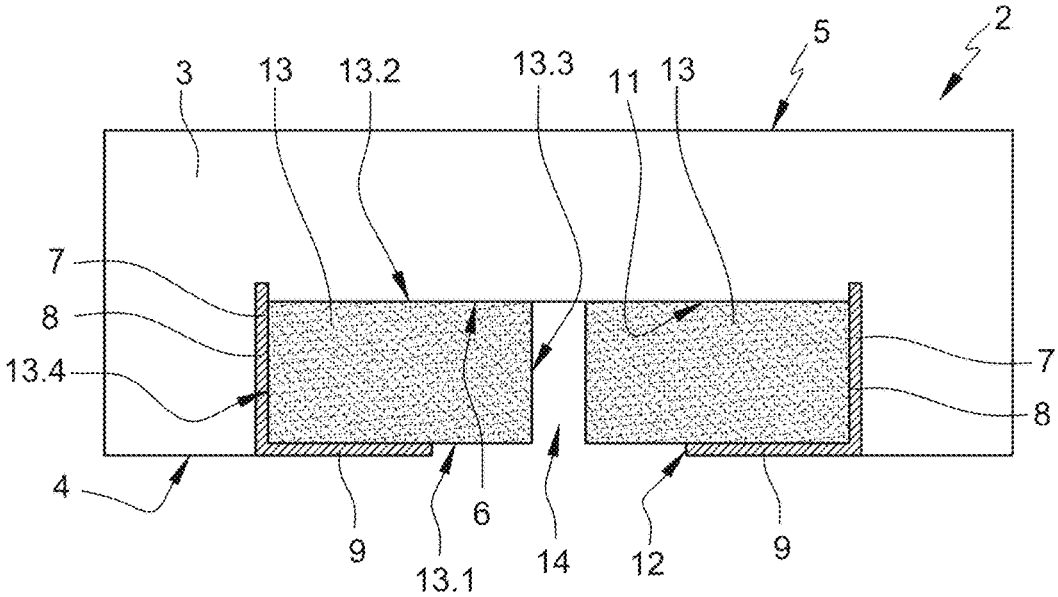
FIG. 2 is a cross-sectional view of the acoustic attenuation device of FIG. 1.

FIGS. 1 and 2 represent an acoustic attenuation device 2 adapted to achieve an acoustic attenuation of the noise in a building, such as for example an individual dwelling, a collective dwelling, an office building, an agricultural or semi-agricultural building. The acoustic attenuation device 2 may be used both to provide an acoustic insulation for a new building or for the renovation of an old building. The acoustic attenuation device 2 may be fastened to a wall or a ceiling of the building, or be integrated into a ceiling of the building.

The acoustic attenuation device 2 advantageously has a generally parallelepipedal shape. The acoustic attenuation device 2 may for example have a thickness less than or equal to 0.1 m, a width less than or equal to 0.5 m, and a length less than or equal to 1.2 m.

According to the embodiment represented in FIGS. 1 and 2, the acoustic attenuation device 2 comprises a structural layer 3 which has a substantially parallelepipedal shape and which comprises a first external surface 4 and a second external surface 5 opposite to the first surface external 4. The first external surface 4 of the structural layer 3 is intended to be oriented towards a space to be acoustically attenuated.

The structural layer 3 is advantageously made of a substantially acoustically impermeable material which advantageously has an acoustic absorption coefficient $\alpha$ less than 0.2, and for example less than 0.1.

According to one embodiment of the present disclosure, the structural layer 3 is obtained by hardening a cementitious composition comprising in particular a hydraulic binder, at least one adjuvant, water and granulates or aggregates, such as sand. The hydraulic binder advantageously includes at least one cement chosen from a Portland cement, an aluminous cement, a sulfoaluminate cement and/or a prompt natural cement. The structural layer 3 may for example be made of cement concrete.

The structural layer 3 more particularly comprises a longitudinal groove 6 provided on the first external surface 4.

The acoustic attenuation device 2 further comprises two support elements 7 which are made of substantially acoustically impermeable material and which are secured to the structural layer 3. According to the embodiment represented in FIGS. 1 and 2, each support element 7 is metallic, and for example stainless steel, and has an angle iron shape. In addition, according to the embodiment represented in FIGS. 1 and 2, the two support elements 7 are distinct from each other and separated from each other.

Each support element 7 includes a fastening part 8 fastened to a respective lateral wall of the longitudinal groove 6, and a cover part 9 which extends perpendicularly to the respective fastening part 8 and in the plane of extension of the first external surface 4 of the structural layer 3. Each fastening part 8 may for example be partially integrated into the structural layer 3, and be secured to the latter during the hardening of the cementitious composition forming the structural layer 3.

The two support elements 7 and the structural layer 3 delimit an internal cavity 11 which extends longitudinally and which has a globally parallelepiped shape. The cover parts 9 of the two support elements 7, and more particularly the internal longitudinal edges of the cover parts 9, delimit a passage slot 12 which emerges into the internal cavity 11 and which extends over substantially the entire length of the internal cavity 11. The internal cavity 11 has a width greater than the width of the passage slot 12, and communicates with the exterior of the acoustic attenuation device 2 through the passage slot 12.

The acoustic attenuation device 2 also comprises two inserts 13 made of acoustically absorbent material disposed in the internal cavity 11. According to the embodiment represented in FIGS. 1 and 2, each insert 13 is elongated and extends in a direction of extension. Advantageously, each insert 13 extends substantially parallel to the passage slot 12. Each insert 13 may for example have a rectangular section.

According to one embodiment of the present disclosure, each insert 13 is made of hemp concrete. However, according to one variant of the present disclosure, each insert 13 could be made of mineral wool, for example glass wool or rock wool, or an acoustically absorbent foam.

The two inserts 13 are distinct from each other and are separated from each other so as to delimit between them a longitudinal slot 14 which is substantially parallel to the passage slot 12 and to the direction of extension of the inserts 13. Advantageously, the longitudinal slot 14 is centered with respect to the passage slot 12.

Advantageously, the passage slot 12 has a width greater than the width of the longitudinal slot 14 and is located opposite the longitudinal slot 14 so as to free an access to the longitudinal slot 14.

Each insert 13 includes a front surface 13.1 intended to be oriented towards the space to be acoustically attenuated, a rear surface 13.2 oriented towards the bottom of the internal cavity 11, a first lateral surface 13.3 partially delimiting the longitudinal slot 14 and a second lateral surface 13.4 oriented towards a respective fastening part 8.

As shown more particularly on FIG. 2, the cover part 9 of each support element 7 partially covers the front surface 13.1 of a respective insert 13 so that the front surfaces 13.1 of the two inserts 13 are partially exposed. Advantageously, each cover part 9 has a thickness less than the thickness of the respective insert 13, and at least 15% of the front face 13.1 of each insert 13 is exposed.

According to one embodiment of the present disclosure, the passage slot 12 has a width comprised between 2 to 10 cm, and for example between 7 and 8 cm, and the longitudinal slot 14 has a width comprised between 0.5 to 1.9 cm, and for example about 1 cm or about 1.5 cm. According to one embodiment of the present disclosure, each cover part 9 has a thickness comprised between 1 mm and 3 cm, and for example between 1 and 5 mm, and each insert 13 has a thickness comprised between 3 and 10 cm, and for example between 3.5 and 6 cm. Each insert 13 may also have a width comprised between 3 and 8 cm, and for example between 4 and 6 cm.

Figure 3:
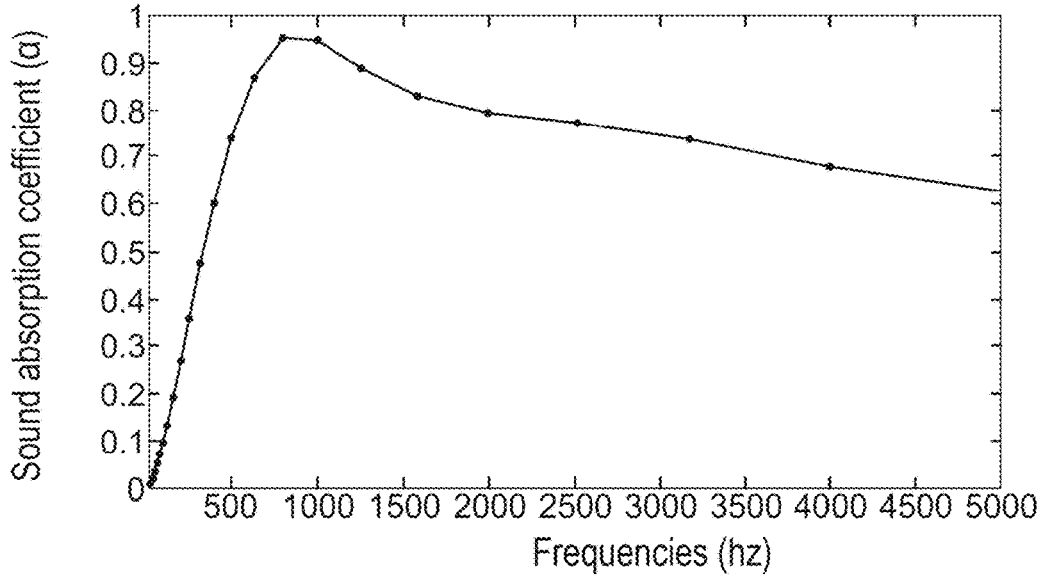
FIG. 3 is a diagram representing the variation as a function of the frequency of an acoustic absorption coefficient of the acoustic attenuation device of FIG. 1.

As shown on FIG. 3, such a configuration of the acoustic attenuation device 2 makes it possible to obtain an average acoustic absorption coefficient of approximately 0.7 over the frequency range 500 Hz-5000 Hz, and this for a structural layer 3 having a low thickness and made of cement concrete and for cover parts 9 of 3 mm thickness and inserts 13 of 5 cm thickness.

Figure 4:
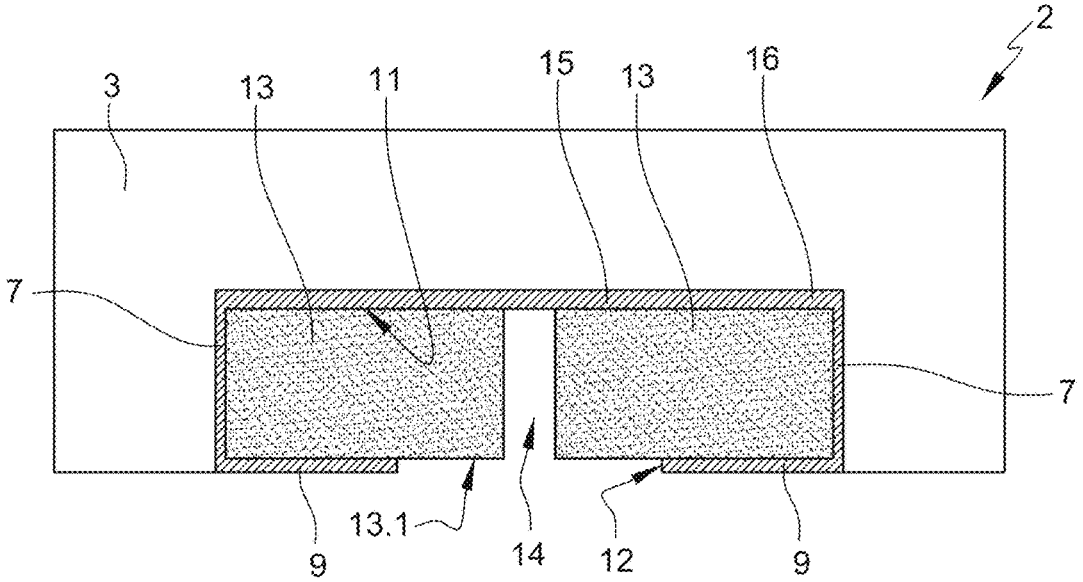
FIG. 4 is a cross-sectional view of an acoustic attenuation device according to a second embodiment of the present disclosure.

FIG. 4 represents an acoustic attenuation device 2 according to a second embodiment of the present disclosure which differs from the first embodiment essentially in that the acoustic attenuation device 2 include a rear wall 15, for example made of substantially acoustically impermeable material, which connects the fastening parts 8 of the two support elements 7 to each other and which has a length substantially identical to that of the support elements 7, and in that the rear wall 15 and the two support elements 7 form a box 16 of generally parallelepipedal shape and delimit the internal cavity 11 in which the two inserts 13 are disposed. Advantageously, the rear wall 15 and the two support elements 7 are made in a single piece.

According to such an embodiment of the present disclosure, the two support elements 7 respectively form the two lateral walls of the box 16, and the two cover parts 9 extend substantially parallel to the rear wall 15.

Figure 5:
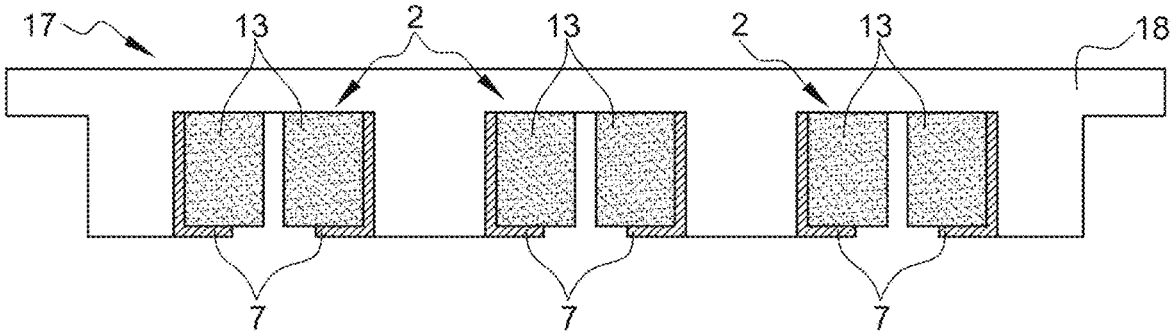
FIG. 5 is a cross-sectional view of a construction element comprising a plurality of acoustic attenuation devices according to a third embodiment of the present disclosure.

FIG. 5 represents a construction element 17 for a building, such as a pre-slab, comprising a support structure 18 made of substantially acoustically impermeable material and a plurality of acoustic attenuation devices 2 disposed substantially parallel to each other and conforming to a third embodiment of the present disclosure.

The substantially acoustically impermeable material forming the support structure 18 advantageously has an acoustic absorption coefficient less than 0.2, and for example less than 0.1. Advantageously, the support structure 18 is obtained by hardening a cementitious composition, and may for example be made of cement concrete.

Each acoustic attenuation device 2 according to the third embodiment of the present disclosure differs from the first embodiment represented in FIGS. 1 and 2 essentially in that it lacks a structural layer 3. The two support elements 7 and the two inserts 13 of each acoustic attenuation device 2 are in particular secured to the support structure 18 by partially embedding them in the cementitious composition forming the support structure 18 before it hardens.

According to one variant of the construction element 17 of FIG. 5, acoustic attenuation devices 2 according to the first embodiment could be secured to the support structure 18.

Figure 6:
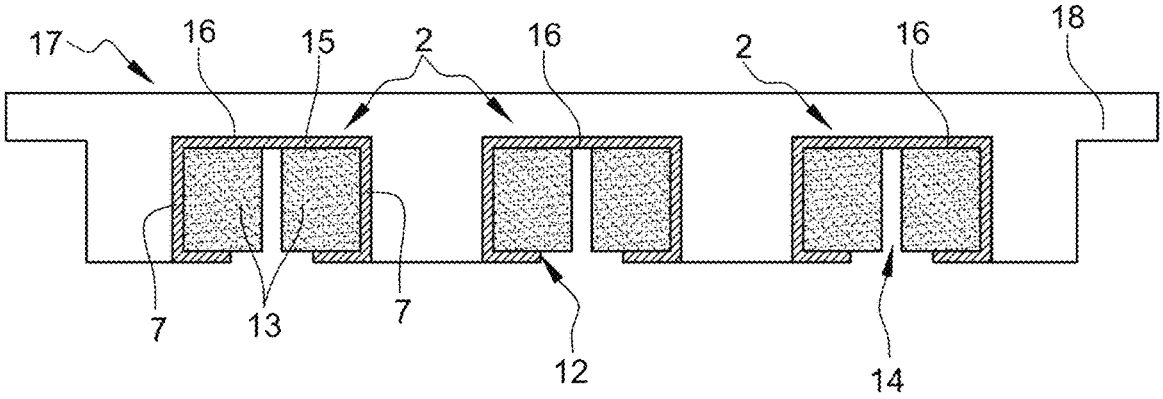
FIG. 6 is a cross-sectional view of a construction element comprising a plurality of acoustic attenuation devices according to a fourth embodiment of the present disclosure.

FIG. 6 represents a construction element 17 for a building, such as a pre-slab, comprising a support structure 18 made of substantially acoustically impermeable material and a plurality of acoustic attenuation devices 2 disposed substantially parallel to each other and conforming to a fourth embodiment of the present disclosure.

Each acoustic attenuation device 2 according to the fourth embodiment of the present disclosure differs from the second embodiment represented in FIG. 4 essentially in that it lacks a structural layer 3.

The box 16 formed by the rear wall 15 and the two support elements 7 of each acoustic attenuation device 2 may be secured to the support structure 18 in different ways. The box 16 may for example be partially embedded in the cementitious composition forming the support structure 18 before it hardens, or may be attached to the support structure 18 and be fastened to the latter, for example by gluing, clipping, screwing or by any other mean.

According to one variant of the construction element 17 of FIG. 6, acoustic attenuation devices 2 according to the second embodiment could be secured to the support structure 18.

Figure 7:
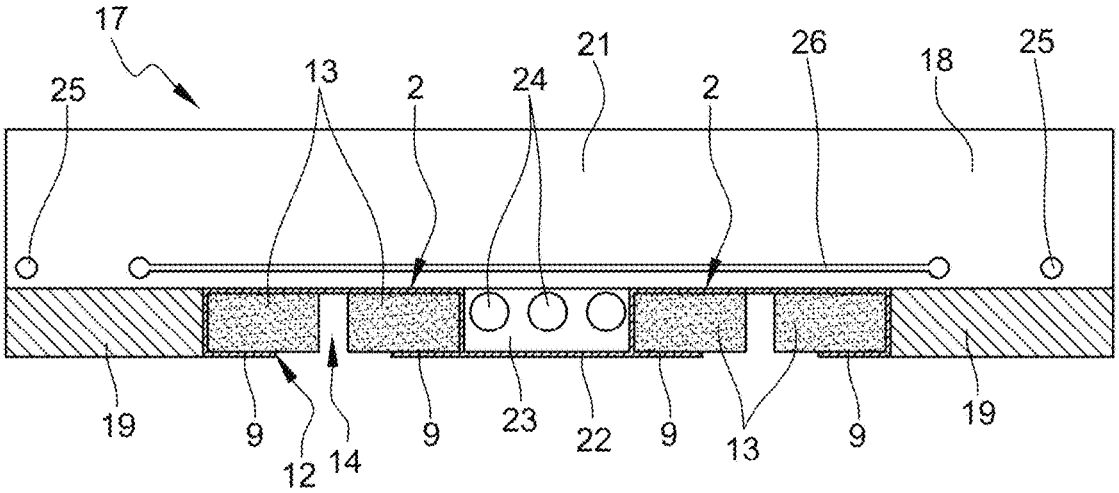
FIG. 7 is a cross-sectional view of a construction element comprising a plurality of acoustic attenuation devices according to a fifth embodiment of the present disclosure.

FIG. 7 represents a construction element 17 for a building, such as a slab, comprising a support structure 18 made of substantially acoustically impermeable material and a plurality of acoustic attenuation devices 2 disposed substantially parallel to each other and conforming to a fifth embodiment of the present disclosure.

According to the embodiment represented in FIG. 7, the support structure 18 includes:

- a plurality of concrete pre-slabs 19 spaced apart from each other, one or more acoustic attenuation devices 2 being disposed between two adjacent concrete pre-slabs 19, and
- a concrete layer 21 poured over the concrete pre-slabs 19 and the acoustic attenuation devices 2 so as to secure the concrete pre-slabs 19 and the acoustic attenuation devices 2.

According to such an embodiment of the present disclosure, said plurality of acoustic attenuation devices notably includes two adjacent acoustic attenuation devices 2 which are connected to each other by a connecting wall 22. The connecting wall 22 advantageously extends in the plane of extension of the cover parts 9 of the two adjacent acoustic attenuation devices 2 and partially delimits a longitudinal internal chamber 23 in which longitudinal elements 24, such as fluid pipes and/or electrical cables, may be disposed.

The construction element 17 represented in FIG. 7 further includes fluid flow tubes 25, such as PEX tubes, positioned on the pre-slabs and embedded in the concrete layer 21, and connecting elements 26 which are configured to fluidically connect the fluid flow tubes 25 between them and which are also positioned on the pre-slabs and embedded in the concrete layer 21.

Such a configuration of the construction element 17 makes it possible to obtain an active slab having improved acoustic performance, while allowing an easy access to the fluid pipes and/or electrical cables disposed in the longitudinal internal chamber 23 when, for example, the connecting wall 22 is removably fastened to the adjacent acoustic attenuation devices 2 or when the adjacent acoustic attenuation devices 2 are removably fastened to the support structure 18.

Figure 8:
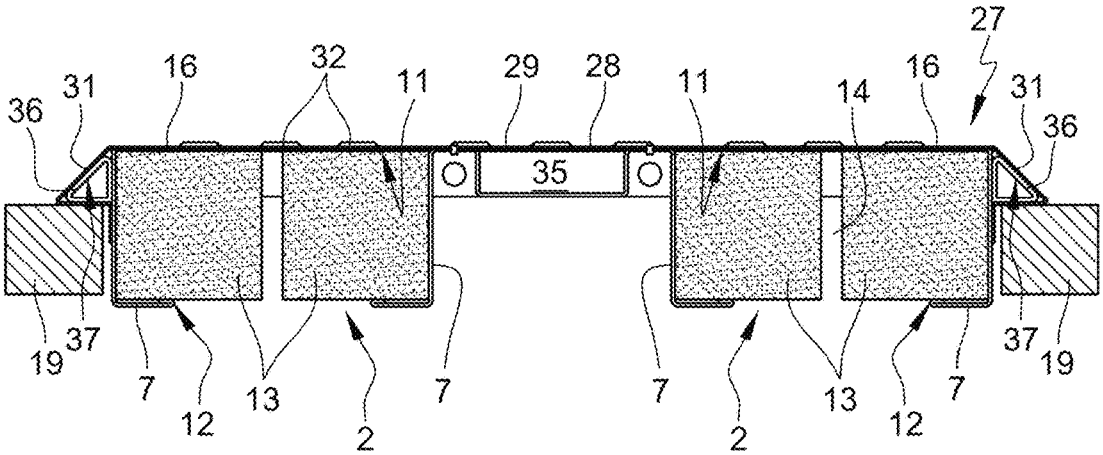
FIG. 8 is a cross-sectional view of an acoustic attenuation assembly comprising two acoustic attenuation devices according to a sixth embodiment of the present disclosure.
Figure 9:
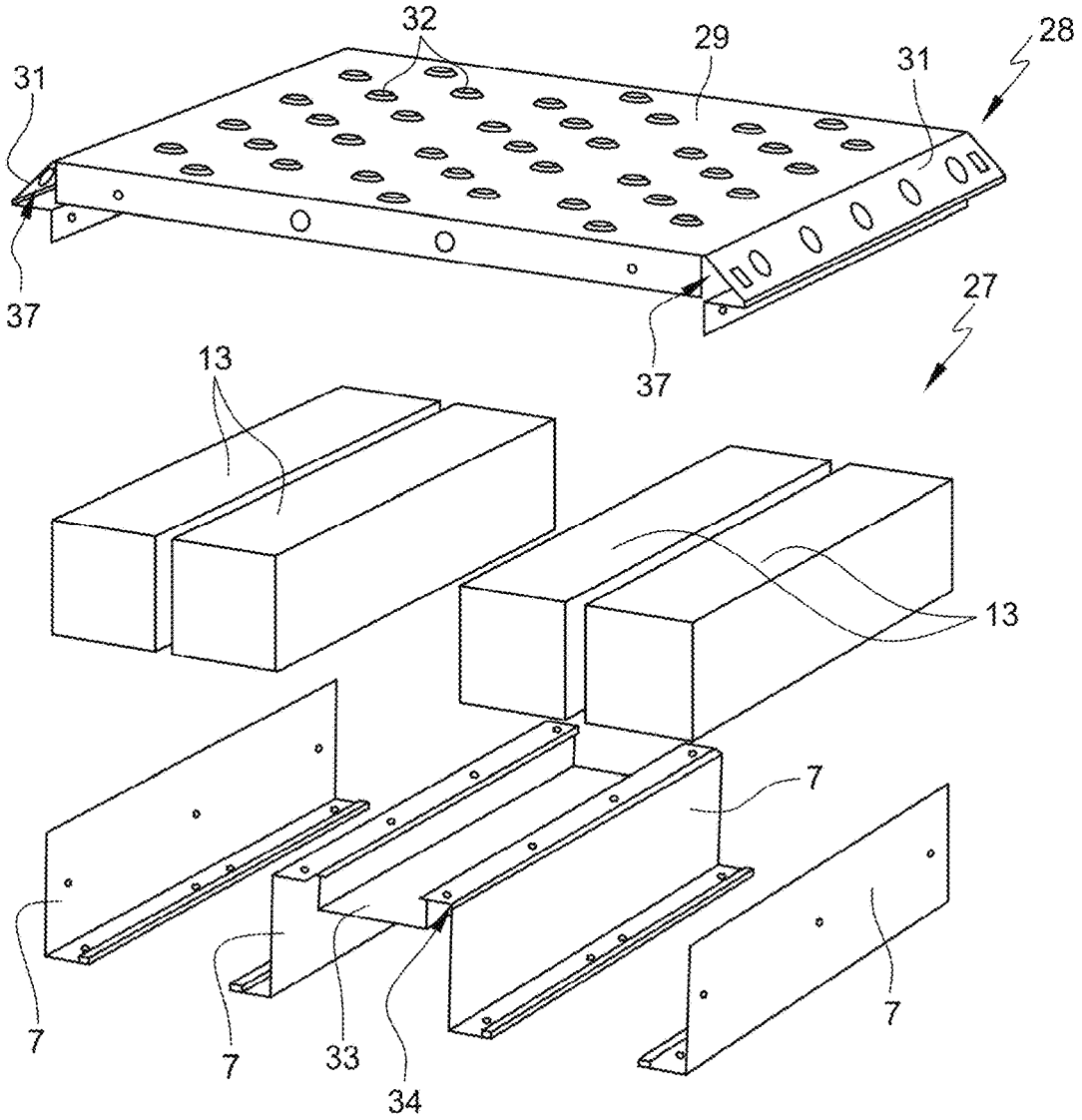
FIG. 9 is an exploded perspective view of the acoustic attenuation assembly of the FIG. 8.

FIGS. 8 and 9 represent an acoustic attenuation assembly 27 which is configured to be disposed between two adjacent concrete pre-slabs 19 and which comprises two acoustic attenuation devices 2 conforming to a sixth embodiment of the present disclosure. Advantageously, the acoustic attenuation assembly 27 is configured to rest on the concrete pre-slabs 19, and the two acoustic attenuation devices 2 are spaced from each other and extend substantially in the same plane of extension.

The acoustic attenuation assembly 27 includes a retaining element 28 which is advantageously metallic and which may for example be obtained by bending a metal sheet. The retaining element 28 includes a retaining part 29 which is substantially planar and which may for example have a rectangular shape.

The support elements 7 of the two acoustic attenuation devices 2 are fastened to the retaining part 29 in such a way that the retaining part 29 and the support elements 7 form two boxes 16 and delimit two internal cavities 11 in each of which the two respective inserts 13 are disposed. The two lateral portions of the retaining part 29 more particularly form two rear walls each connecting the two respective support elements 7.

The retaining element 28 further includes two lateral bearing parts 31 which extend substantially parallel to one another and which are configured to rest on the pre-slabs 19. The lateral bearing parts 31 extend more particularly from two opposite lateral edges of the retaining part 29.

The retaining part 29 may advantageously include, on its face opposite the acoustic attenuation devices 2, anti-slip projections 32, such as anti-slip pads. The presence of such anti-slip projections 32 makes it possible to prevent a slipping, and therefore a fall, of a person having to move on the retaining part 29, in particular when the acoustic attenuation assembly 27 is intended to be incorporate into the ceiling of a building.

According to the embodiment represented in FIGS. 8 and 9, the acoustic attenuation assembly 27 includes a support piece 33 which is fastened to the retaining element 28, and more particularly to the retaining part 29, and which extends in a middle part of the retaining part 29. The support piece 33 includes two lateral branches which respectively form the adjacent support elements 7 of the two acoustic attenuation devices 2. The support piece 33 further includes a central chute 34 which connects the two lateral branches of the support piece 33 to each other. The central chute 34 and the retaining part 29 delimit a central cavity 35.

According to the embodiment represented in FIGS. 8 and 9, the support elements 7, which are configured to be located close to the pre-slabs 19, each have an angle iron shape and are fastened to the retaining element 28, and for example to the lateral bearing parts 31.

According to one embodiment of the present disclosure, two adjacent acoustic attenuation assemblies 27 may be assembled to one another through two assembly pieces 36 introduced into receiving housings 37 delimited for example by the lateral bearing parts 31.

Advantageously, a concrete layer may be poured over the concrete pre-slabs 19 and the acoustic attenuation assembly 27 so as to secure the concrete pre-slabs 19 and the acoustic attenuation assembly 27, and to form a construction element for a building, such as a slab. Fluid flow tubes, such as PEX tubes, may advantageously be positioned on the pre-slabs 19 and be embedded in the concrete layer, so as to form an active slab.

Figure 10:
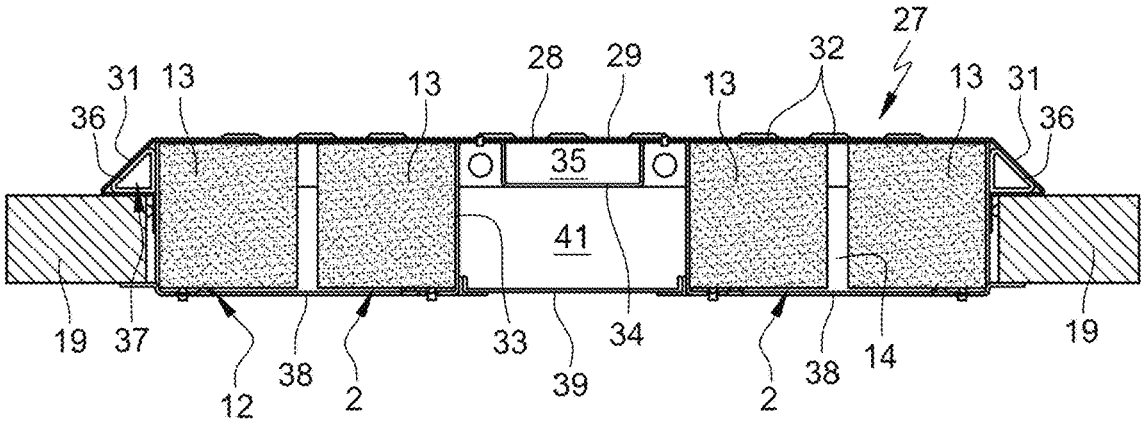
FIG. 10 is a cross-sectional view of an acoustic attenuation assembly comprising two acoustic attenuation devices according to a seventh embodiment of the present disclosure.

FIG. 10 represents an acoustic attenuation assembly 27 which differs from that represented in FIGS. 8 and 9 essentially in that it further includes perforated cover elements 38, such as perforated cover plates or perforated cover grids, which partially cover the passage slots 12 delimited by the support elements 7. Advantageously, each perforated cover element 38 is metallic, and has a perforation rate greater than 70%.

According to the embodiment represented in FIG. 10, each perforated cover element 38 is fastened, preferably in a removable manner, to the cover parts 9 of the support elements 7 of a same acoustic attenuation device 2.

The acoustic attenuation assembly 27 represented on FIG. 10 also includes a closure plate 39 which is removable and which delimits, with the support piece 33, an internal chamber 41 in which longitudinal elements, such as fluid pipes and/or electric cables, may be disposed. The closure plate 39 advantageously extends substantially in the plane of extension of the cover parts 9 of the two adjacent acoustic attenuation devices 2.

According to the embodiment represented in FIG. 10, the closure plate 39 rests on internal lateral edges of the perforated cover elements 38. According to one variant of the present disclosure, the closure plate 39 could be removably fastened to the support piece 33, and for example to the support elements 7 adjacent to the two acoustic attenuation devices 2.

Such an arrangement of the closure plate 39 gives a more aesthetic appearance to the acoustic attenuation assembly 27. In addition, the presence of the central chute 34 makes it possible to avoid, for example when fastening longitudinal elements in the internal chamber 41, to pierce the concrete layer covering the acoustic attenuation assembly 27, and therefore to pierce any fluid flow tubes embedded in the concrete layer.

It goes without saying that the present disclosure is not limited to the embodiments of this acoustic attenuation device, described above by way of examples, on the contrary it embraces all variants. It is thus in particular that each support element could be made of cement concrete, and for example of Ultra High Performance Fiber Concrete (UHP-FRC), and that the acoustic attenuation device could include a plurality of passage openings, for example of circular, rectangular or any other shape section, instead of the passage slot.

The invention claimed is:

1. An acoustic attenuation device including:

two inserts made of acoustically absorbent material, the two inserts being distinct from each other and being separated from each other, the two inserts respectively including two inner lateral surfaces directly facing each other and delimiting between them a longitudinal slot, each of the two inserts including a front surface intended to be oriented towards a space to be acoustically attenuated, and two support elements which are made of substantially acoustically impermeable material and which at least partially delimit an internal cavity in which the two inserts are disposed, each support element of the two support elements supporting a respective insert of the two inserts, each support element of the two support elements including a cover part partially covering the front surface of the respective insert of the two inserts such that the front surfaces of the two inserts are partially exposed, internal longitudinal edges of the cover parts of the two support elements directly facing each other and delimiting at least one passage opening which emerges into the internal cavity and which is located at least partially opposite the longitudinal slot so as to clear an access to the longitudinal slot.

2. The acoustic attenuation device according to claim 1, wherein the at least one passage opening is a passage slot which has a width greater than a width of the longitudinal slot.

3. The acoustic attenuation device according to claim 2, wherein the passage slot (12) is substantially parallel to the longitudinal slot.

4. The acoustic attenuation device according to claim 3, wherein each insert of the two inserts is elongated and extends in a direction of extension.

5. The acoustic attenuation device according to claim 4, wherein each insert of the two inserts is made of hemp concrete.

6. The acoustic attenuation device according to claim 5, wherein the cover part of each of the two support elements has a thickness less than a thickness of a respective insert of the two inserts.

7. The acoustic attenuation device according to claim 6, wherein the two support elements are metallic.

8. The acoustic attenuation device according to claim 1, wherein each insert of the two inserts is elongated and extends in a direction of extension.

9. The acoustic attenuation device according to claim 1, wherein each insert of the two inserts is made of hemp concrete.

10. The acoustic attenuation device according to claim 1, wherein the cover part of each of the two support elements has a thickness less than a thickness of a respective insert of the two inserts.

11. The acoustic attenuation device according to claim 1, wherein the two support elements are metallic.

12. The acoustic attenuation device according to claim 1, wherein the two support elements are made of cement concrete.

13. The acoustic attenuation device according to claim 1, wherein the two support elements each have an angle iron shape.

14. The acoustic attenuation device according to claim 1, further comprising a rear wall connecting the two support elements to each other, the rear wall and the two support elements forming a box and delimiting the internal cavity in which the two inserts are disposed.

15. The acoustic attenuation device according to claim 1, further comprising a structural layer which is made of substantially acoustically impermeable material, the two inserts and the two support elements being fastened to the structural layer.

16. The acoustic attenuation device according to claim 15, wherein the structural layer is obtained by hardening a cementitious composition.

17. The acoustic attenuation device according to claim 1, wherein the cover part of each of the two support elements is in direct contact with the respective insert of the two inserts.

18. An acoustic attenuation assembly comprising a retaining element and at least two acoustic attenuation devices according to claim 1, each acoustic attenuation device of the two acoustic attenuation devices being fastened to the retaining element.

19. A construction element for a building comprising a support structure and a plurality of acoustic attenuation devices according to claim 1, each acoustic attenuation device of the two acoustic attenuation devices being fastened to the support structure.

20. The construction element according to claim 19, wherein the support structure is obtained by hardening a hardenable material.

* * * * *